US011433411B2

(12) United States Patent
Manabe et al.

(10) Patent No.: US 11,433,411 B2
(45) Date of Patent: Sep. 6, 2022

(54) PAINTING METHOD, PAINTING DEVICE AND PAINTING PROGRAM

(71) Applicant: Taikisha Ltd., Tokyo (JP)

(72) Inventors: Keiji Manabe, Tokyo (JP); Chikara Hasegawa, Tokyo (JP)

(73) Assignee: Taikisha Ltd., Tokyo (JP)

( * ) Notice: Subject to any disclaimer, the term of this patent is extended or adjusted under 35 U.S.C. 154(b) by 0 days.

(21) Appl. No.: 17/051,733

(22) PCT Filed: Mar. 12, 2020

(86) PCT No.: PCT/JP2020/010840
§ 371 (c)(1),
(2) Date: Oct. 29, 2020

(87) PCT Pub. No.: WO2021/053860
PCT Pub. Date: Mar. 25, 2021

(65) Prior Publication Data

US 2021/0245189 A1 Aug. 12, 2021

(30) Foreign Application Priority Data

Sep. 20, 2019 (JP) ..... JP2019-171945

(51) Int. Cl.

| | |
|---|---|
| ***B05B 12/12*** | (2006.01) |
| ***B05D 1/02*** | (2006.01) |
| *B05B 13/04* | (2006.01) |
| *B05D 1/40* | (2006.01) |

(52) U.S. Cl.
CPC ..... *B05B 12/122* (2013.01); *B05B 13/0431* (2013.01); *B05D 1/02* (2013.01); *B05D 1/40* (2013.01)

(58) Field of Classification Search
None
See application file for complete search history.

(56) References Cited

U.S. PATENT DOCUMENTS

| | | | | |
|---|---|---|---|---|
| 6,338,441 | B1 | 1/2002 | Umezawa et al. | |
| 6,592,672 | B1 * | 7/2003 | Mizuno | B05B 7/0815 118/669 |
| 2018/0147590 | A1 | 5/2018 | Chen et al. | |

FOREIGN PATENT DOCUMENTS

| | | | | |
|---|---|---|---|---|
| CN | 108114821 | A | 6/2018 | |
| DE | 10103067 | A1 | 7/2002 | |
| EP | 2641661 | A1 * | 9/2013 | B05B 12/1472 |
| EP | 2641661 | A1 | 9/2013 | |
| JP | H4111490 | A | 4/1992 | |
| JP | H6121944 | A | 5/1994 | |
| JP | H952067 | A | 2/1997 | |
| JP | 2006133671 | A | 5/2006 | |
| JP | 2013656 | A | 1/2013 | |
| JP | 2016150306 | A | 8/2016 | |

* cited by examiner

*Primary Examiner* — Michael P. Rodriguez
(74) *Attorney, Agent, or Firm* — The Webb Law Firm

(57) ABSTRACT

A painting method for painting a painting subject area whose edge shape is delimited by at least one demarcation line. The method includes a center portion painting step of painting a center portion of the painting subject area which is away from the demarcation line using an air atomizing nozzle disposed within 5 cm or less from a painting subject surface, and a frame portion painting step of painting a frame portion of the painting subject area which is adjacent the demarcation line using a jet nozzle.

9 Claims, 3 Drawing Sheets

PAINTING METHOD, PAINTING DEVICE AND PAINTING PROGRAM

CROSS-REFERENCE TO RELATED APPLICATIONS

This application is the United States national phase of International Application No. PCT/JP2020/010840 filed Mar. 12, 2020, and claims priority to Japanese Patent Application No. 2019-171945 filed Sep. 20, 2019, the disclosures of which are hereby incorporated by reference in their entirety.

TECHNICAL FIELD

This invention relates to a painting method, a painting device, and a painting program for painting a painting subject area whose edge shape is delimited by at least one demarcation line.

RELATED ART

When a predetermined painting subject area on a painting subject surface is to be painted, it is required to clearly draw its demarcation line (parting line). For clear drawing of the demarcation line, there is a need for a method which allows paint to be adhered to the painting subject area only, not to the other area (non-painting subject area). As a simple method, there is a method including steps of providing masking outside the painting subject area, painting the painting subject area, and then removing the masking. However, this method is undesirable in terms of painting efficiency as the method requires the steps for providing and removing the masking. Thus, there has been contemplated a painting method that allows clear drawing of a demarcation line without the need for the masking.

For instance, Japanese Unexamined Patent Application Publication Hei. 6-121944 (Patent Document 1) discloses a painting method configured to carry out painting simultaneously by a dot painting gun and an airless gun. With the technique of Patent Document 1, a high-quality parting line can be formed by using the dot painting gun.

PRIOR ART DOCUMENT

Patent Document

Patent Document 1: Japanese Unexamined Patent Application Publication Hei. 6-121944 document.

SUMMARY

Problem to be Solved by Invention

However, with such technique as that of Patent Document 1, since the discharging width of paint provided by the airless gun is relatively large, the paint may sometimes get adhered to the vicinity of the parting line inadvertently, thus blurring the demarcation line. Further, to avoid this, it is necessary to increase the area to be painted by the dot painting gun; however, if the area to be painted by the dot painting gun which provides only a small painting area per unit time was increased, this would sometimes result in a reduction in the painting efficiency. Also, with such technique as that of Patent Document 1, as the technique assumes a straight parting line, it was difficult to paint a painting subject area having a complicated shape.

Given the above, there is a need for realization of a painting method, a painting device, and a painting program that allow drawing of a clear demarcation line (parting line) in a relatively short period of time even if the shape of the painting subject area is complicated.

Solution

A painting method relating to the present invention for painting a painting subject area whose edge shape is delimited by at least one demarcation line, the method comprises the steps of:

a center portion painting step of painting a center portion of the painting subject area which is away from the demarcation line, with using an air atomizing nozzle disposed within 5 cm or less from a painting subject surface; and a frame portion painting step of painting a frame portion of the painting subject area which is adjacent to the demarcation line, with using a jet nozzle.

With the above-described arrangement, even if the painting subject area has a complicated shape, a clear demarcation line can be drawn within a relatively short period of time.

A painting device according to the present invention for painting a painting subject area whose edge shape is delimited by at least one demarcation line, the painting device comprising:

an air atomizing nozzle configured to be capable of painting a center portion of the painting subject area, the center portion being away from the demarcation line;

a jet nozzle configured to be capable of painting a frame portion of the painting subject area, the frame portion being adjacent the demarcation line;

an imaging device capable of imaging the painting subject area to generate image data of the painting subject area;

a controlling section capable of controlling the air atomizing nozzle and the jet nozzle; and an arithmetic section capable of executing an arithmetic processing for identifying an unpainted area in the painting subject area based on the image data;

wherein the controlling section controls the air atomizing nozzle in an area within 5 cm or less from a painting subject surface and controls the jet nozzle for painting the unpainted area identified by the arithmetic section.

Further, a painting program relating to the present invention for controlling a painting device having an air atomizing nozzle and a jet nozzle to paint a painting subject area whose edge shape is delimited by at least one demarcation line, the painting program causing a computer to execute:

a center portion painting function of painting a center portion of the painting subject area, the center portion being away from the demarcation line, by controlling the air atomizing nozzle in an area located 5 cm or less from a painting subject surface;

a frame portion painting function of painting a frame portion of the painting subject area by controlling the jet nozzle, the frame portion being adjacent the demarcation line;

an imaging function of imaging the painting subject area to generate image data of the painting subject area;

an unpainted area identifying function of identifying an unpainted area in the painting subject area based on the image data; and a correction painting function of painting the unpainted area identified by the unpainted area identifying function.

With the above-described arrangements, even if the painting subject area has a complicated shape, a clear demarcation line can be drawn within a relatively short period of time. Further, since identification and painting of the unpainted area can be executed by control based on the arithmetic processing, it is possible to reduce the amount of work for a finishing work by human power.

Preferred embodiments of the present invention will be explained below. It is understood, however, that the preferred embodiments to be described next shall not limit the scope of the present invention.

In the painting method relating to the present invention, in one preferred embodiment thereof, the method further comprises, after the center portion painting step, an imaging step of imaging the painting subject area to generate image data of the painting subject area;

an unpainted area identifying step of executing an arithmetic processing of identifying an unpainted area in the painting subject area based on the image data; and a correction painting step of painting the unpainted area identified at the unpainted area identifying step.

With the above-described arrangement, since identification and painting of the unpainted area can be executed by control based on the arithmetic processing, it is possible to reduce the amount of work for a finishing work by human power.

In the painting method relating to the present invention, in a preferred embodiment thereof, at the correction painting step, the unpainted area is painted with using the jet nozzle.

With the above-described arrangement, painting of the unpainted area can be carried out with high precision.

Further and other features and advantages of the present invention will become apparent from the following explanation on illustrative and non-limiting embodiments, with reference to the accompanying drawings.

DESCRIPTION OF THE INVENTION

Figure 1:
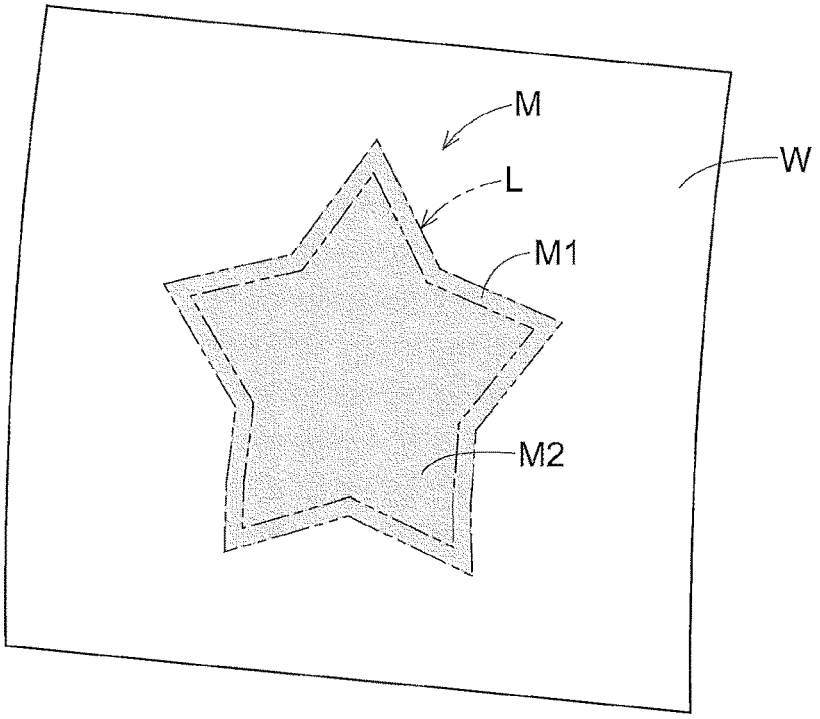
FIG. 1 is a view showing an example of a painting subject area relating to an embodiment of the present invention.

A painting method and a painting program relating to the present invention will be explained with reference to the drawings. In the following discussion, there will be explained an example (FIG. 1) in which a logomark M (an example of a "painting subject area") is to be painted in black color on a painting subject surface W having white color. The logomark M herein is an area whose outer edge shape is delimited by a demarcation line L which is a closed-loop curved line and which has a frame portion M1 as a portion of the area adjacent the demarcation line L and a center portion M2 as a portion of the area away from the demarcation line L. Further, an unpainted area or an area not to be painted included in the area in which painting of the logomark M is contemplated will be defined as an unpainted area M0.

Arrangement of Painting Device

Figure 2:
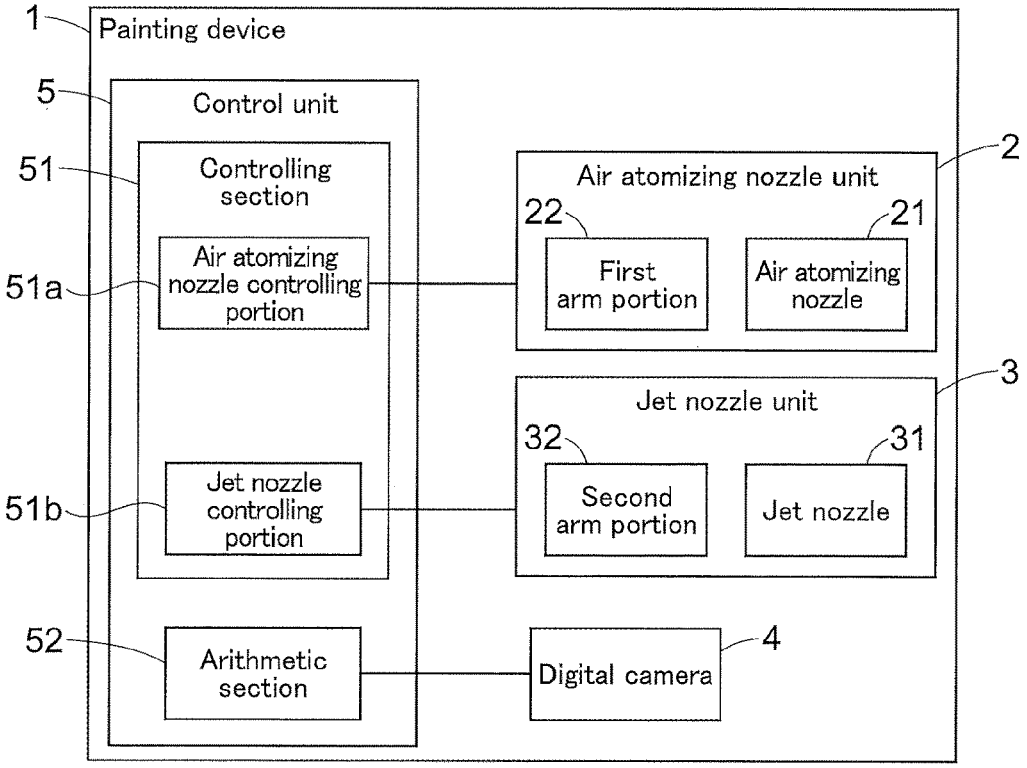
FIG. 2 is an arrangement diagram of a painting device relating to the embodiment of the present invention.

First, an arrangement of a painting device 1 used in the painting method relating to the present invention will be explained. The painting device 1 relating to this embodiment includes an air atomizing nozzle unit 2, a jet nozzle unit 3, a digital camera 4 (an example of an "imaging device"), and a control unit 5 (FIG. 2).

The air atomizing nozzle unit 2 is configured such that an air atomizing nozzle 21 is provided at a leading end of a first arm portion 22. To the air atomizing nozzle 21, there are connected a paint feeding pipe for feeding paint and a compressed air feeding pipe for feeding compressed air (neither of these shown). From a discharge opening provided at the leading end of the air atomizing nozzle 21, paint in the form of mist in which paint droplets are dispersed in an air current formed by the compressed air will be discharged. The first arm portion 22 acts to move the air atomizing nozzle 21 to a desired position, and regulates the relative position of this air atomizing nozzle 21 relative to a painting subject surface W.

The jet nozzle unit 3 is configured such that a jet nozzle 31 is provided at a leading end of a second arm portion 32. To the jet nozzle 31, there is connected a paint feeding pipe (not shown) for feeding paint. From a jetting opening provided at the leading end of the jet nozzle 31, paint in the form of microdroplets is jetted continuously. The second arm portion 32 acts to move the jet nozzle 31 to a desired position, and regulates the relative position of this jet nozzle 31 relative to the painting subject surface W.

The air atomizing nozzle 21 and the jet nozzle 31 discharge paint by methods different from each other, thus having different painting performances. The jet nozzle 31 can direct and land the paint droplets onto a target position in a pin-pointed manner, so a demarcation line on the inner side and outer side of a painted portion can be drawn with precision easily. However, since the jet nozzle 31 discharges the droplets by a minute unit amount, its painting speed is low. The air atomizing nozzle 21 discharges the paint by a larger unit amount than the jet nozzle 31, so the air atomizing nozzle 21 can carry out painting at a higher speed than the jet nozzle 31. On the other hand, as the air atomizing nozzle 21 discharges the paint in the form of mist, this may cause attachment of the paint to the peripheral edge of the target position also. Thus, the demarcation line on the inner and outer sides of the painted portion tends to be unclear or blurred in comparison with the case of using the jet nozzle 31. Incidentally, since the air atomizing nozzle 21 allows spraying with high directivity through use of the compressed air, adhesion of paint to such peripheral edge portion can be suppressed more effectively than a nozzle of an air spraying type or a bell mouth type.

The digital camera 4 is configured to be capable of imaging (i.e. capturing an image of) the painting subject surface W and capable of generating image data thereof. The digital camera 4, in particular, is disposed in such a manner as to include the entire logomark M painted on the painting subject surface W within its imaging range. The image data generated by the digital camera 4 is sent to the control unit 5.

The control unit 5 includes a controlling section 51 capable of controlling the respective nozzles and an arithmetic section 52 capable of executing various kinds of arithmetic processing. The controlling section 51 includes an air atomizing nozzle controlling portion 51*a* capable of controlling the air atomizing nozzle unit 2 and a jet nozzle controlling portion 51*b* capable of controlling the jet nozzle unit 3; thus, the controlling section 51 is capable of controlling the positions of the respective nozzles and amounts of paint to be discharged from the respective nozzles. The arithmetic section 52 is capable of executing an arithmetic processing for identifying an unpainted area in the painting process of the logomark M, based on the image data generated by the digital camera 4.

Painting Method

Figure 3:
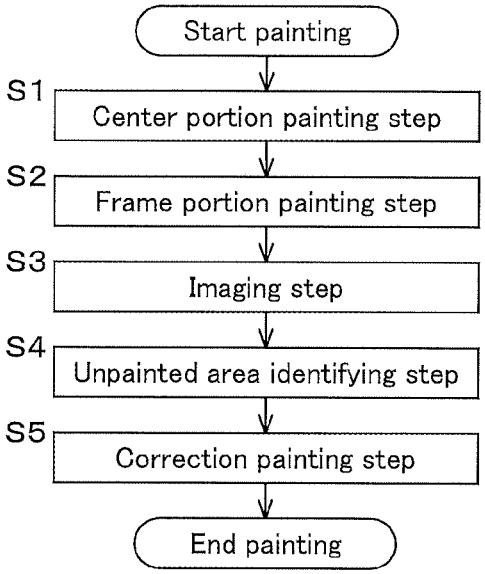
FIG. 3 is a flowchart of a painting method relating to an embodiment of the present invention.

There will be explained the painting method relating to the present invention which is realized with using the painting device 1 below. The painting method relating to this embodiment includes a center portion painting step S1 of painting a center portion M2 with using the air atomizing nozzle 21, a frame portion painting step S2 of painting a frame portion M1 with using the jet nozzle 31, an imaging step S3 of imaging the logomark M after the steps S1, S2 to generate image data thereof (an example of "image"), an unpainted area identifying step S4 of executing, with the arithmetic section 52, an arithmetic processing of identifying an unpainted area M0 based on the image data obtained at step S3, and a correction painting step S5 of painting the unpainted area M0 identified at step S4, with using the jet nozzle 31 (FIG. 3).

Figure 4:
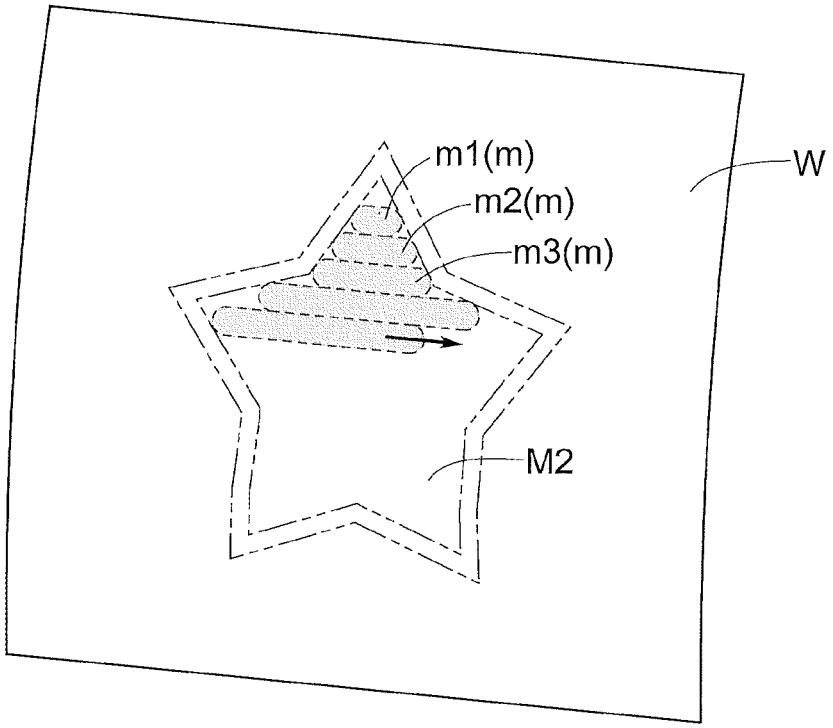
FIG. 4 is a view showing an intermediate state of a center portion painting step in a logomark painting by the painting method relating to the embodiment of the present invention.

At the center portion painting step S1, the center portion M2 of the logomark M is painted with using the air atomizing nozzle 21. More particularly, by driving the first arm portion 22, the air atomizing nozzle 21 is controlled to sweep in the form of a single line from the left side to the right side in FIG. 4 to form a single paint line m1. Thereafter, paint lines m2, m3 . . . parallel with the paint line m1 will be formed one after another (FIG. 4). As described above, since the air atomizing nozzle 21 is more suitable for painting a large area than the jet nozzle 31, the center portion M2 which occupies a major part of the area of the logomark M can be painted at a relatively high speed.

Incidentally, at the center portion painting step S1, the air atomizing nozzle controlling portion 51*a* effects the control in such a manner that the distance of the air atomizing nozzle 21 from the painting subject surface W may be kept within 5 cm or less. By carrying out painting with the above-described disposing arrangement of the air atomizing nozzle 21 in the close vicinity of the painting subject surface W, it is possible to reduce an amount of paint which may land and adhere to the peripheral edge of the target position.

Figure 5:
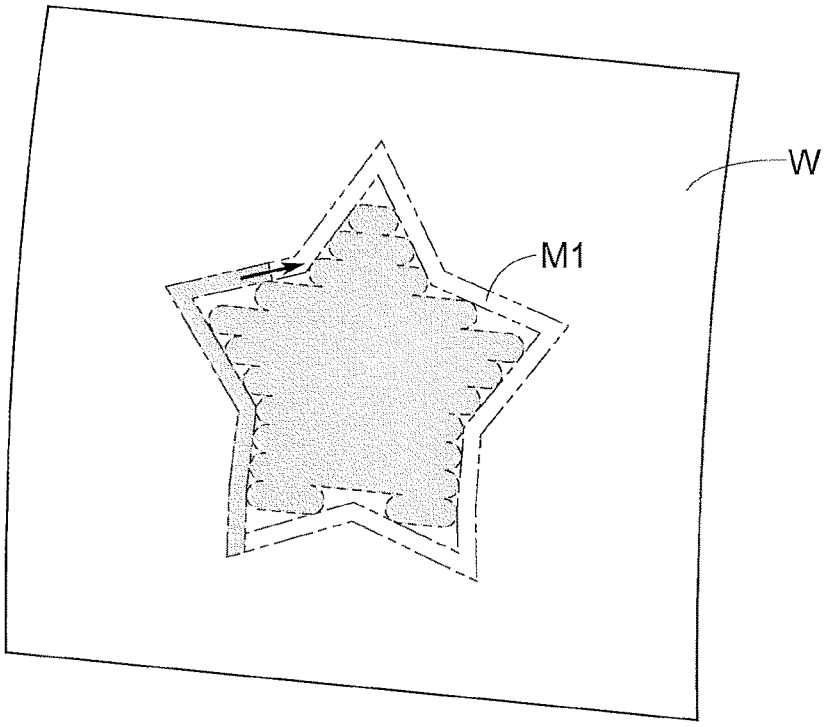
FIG. 5 is a view showing an intermediate state of a frame portion painting step in the logomark painting by the painting method relating to the embodiment of the present invention.

At the frame portion painting step S2, the frame portion M1 of the logomark M is painted with using the jet nozzle 31 (FIG. 5). More particularly, by driving the second arm portion 32, the jet nozzle 31 is controlled to be moved along the shape (contour) of the frame portion M1 to paint this frame portion M1 progressively. As described above, since the jet nozzle 31 is good at precision painting, the demarcation line L delimiting the frame portion M1 and the painting subject surface W from each other can be drawn clearly.

Figure 6:
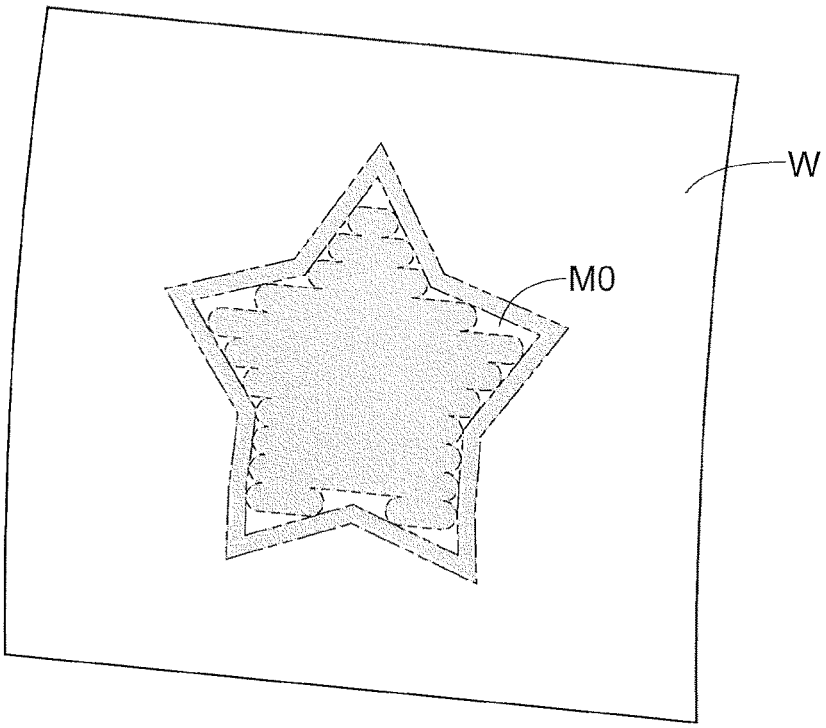
FIG. 6 is a view showing a state after the center portion painting step and the frame portion painting step in the logomark painting by the painting method relating to the embodiment of the present invention.

At the imaging step S3, the logomark (FIG. 6) after completion of the steps S1 and S2, is imaged by the digital camera 4. As the flow of paint in the form of mist discharged from the air atomizing nozzle 21 is discharged in a conical form, the paint will land on the painting subject surface W in an approximately circular shape. To form a paint line (m) by linearly sweeping this approximately circular paint-landed portion, terminal ends of each paint line (m) are rounded. Due to this, as shown in FIG. 6, at each terminal end portion of the respective paint line (m), there will be formed an unpainted area M0 relative to the adjacent paint line (m). The image data generated at step S3 will be sent from the digital camera 4 to the control unit 5 to be used in an arithmetic processing to be executed at the subsequent unpainted area identifying step S4.

At the unpainted area identifying step S4, based on the image data generated at step S3, the arithmetic processing is executed by the arithmetic section 52 for identifying the unpainted area M0 in the logomark M. In this embodiment, the painting subject surface W is painted in white color, whereas the logomark M is to be painted in black color. For this reason, by e.g. an arithmetic processing of binarizing brightness of each pixel in the image data, it is possible to distinguish between a portion in the image data corresponding to a painted area of the logomark M and a portion in the image data corresponding to the unpainted area M0. Namely, the unpainted area M0 can be identified.

At the correction painting step S5, the unpainted area M0 identified at the step S4 is painted with using the jet nozzle 31. More particularly, based on the position of the unpainted area M0 identified at step S4, the second arm portion 32 is driven to move the jet nozzle 31 to a position before the unpainted area M0. Then, paint in the form of fine droplets is jetted from the jet nozzle 31 to be landed on the unpainted area M0. By carrying out this operation for each part of the unpainted area M0 one after another, painting will be done on the unpainted area M0, thus completing the painting of the logomark M.

Other Embodiments

Lastly, other embodiments of the painting method, the painting device, and the painting program relating to the present invention will be explained. Incidentally, it is understood that the arrangements to be disclosed in respective embodiments as follows may be used in any combination with the arrangement(s) disclosed in the other embodiment(s) unless contradiction results from such combination.

In the foregoing embodiment, there was explained an illustrative arrangement in which the logomark M is painted in black color on the painting subject surface W in the white color. However, the invention is not limited to such arrangement, but the colors of the painting subject surface and the painting subject area to be painted by the inventive painting method are not particularly limited.

In the foregoing embodiment, there was explained an illustrative arrangement in which the logomark M as the "painting subject area" is delimited by a single demarcation line L. However, the invention is not limited to such arrangement, but the painting subject area to be painted by the inventive painting method may have a plurality of demarcation lines. Incidentally, such case of a plurality of demarcation lines being present corresponds to e.g. a case of drawing a character (letter) inside a figure or shape in a hollow form. Further, the demarcation line need not be a closed-loop curved line and the inventive painting method may be applied to a two-tone color painting arrangement, for instance.

In the foregoing embodiment, there was explained an arrangement in which the frame portion painting step S2 is executed after the center portion painting step S1. However, the invention is not limited to such arrangement. The inventive painting method may alternatively be embodied such that the center portion painting step is executed after the frame portion painting step.

In the foregoing embodiment, there was disclosed an illustrative arrangement in which at the center portion painting step S1, the air atomizing nozzle 21 is swept linearly. However, the invention is not limited to such arrangement. The mode of controlling the air atomizing nozzle at the center portion painting step in the painting method of the present invention is not particularly limited as long as the air atomizing nozzle is disposed within 5 cm or less from the painting subject surface.

In the foregoing embodiment, there was disclosed an illustrative arrangement in which at the frame portion painting step S2, the jet nozzle 31 is controlled to be moved along the shape (contour) of the frame portion M1. However, the invention is not limited to such arrangement. The mode of controlling the jet nozzle at the frame portion painting step in the painting method of the present invention is not particularly limited.

In the foregoing embodiment, there was disclosed an illustrative arrangement in which identification and painting of the unpainted area M0 are executed by the imaging step S3, the unpainted area identifying step S4, and the correction painting step S5. However, the invention is not limited to such arrangement. In the method relating to the present invention, the imaging step, the unpainted area identifying step, and the correction painting step may each be omitted entirely or partially. For instance, in place of effecting the imaging step and the unpainted area identifying step, the unpainted area may be visually identified by a worker. Further alternatively, the center portion painting step and the frame portion painting step may be configured such that no unpainted area will be formed or generated after completion of these steps of main portion painting step and frame portion painting step.

In the foregoing embodiment, there was disclosed an illustrative arrangement in which the center portion painting step S1, the frame portion painting step S2, the imaging step S3, the unpainted area identifying step S4, and the correction painting step S5 are executed in this order one time for the respective step. However, in the painting method relating to the present invention, a step set including the above respective steps may be executed for a plurality of times. For instance, the painting method relating to the present invention may be configured such that the painting subject area is divided into a plurality of sections and for each section, a step set including the main portion painting step and the frame portion painting step may be executed one after another. With this arrangement, the painting work proceeds for each divided section. So, even if the painting area is relatively large, the moving distance of the painting device can be shortened and the period required for painting can be reduced. Incidentally, in the case also of the inventive painting method including at least one of the imaging step, the unpainted area identifying step, and the correction painting step, it is possible to employ the above-described mode of diving the painting subject area into a plurality of sections. For instance, a step set including the center portion painting step, the frame portion painting step, the imaging step, the unpainted area identifying step, and the correction painting step may be executed one after another for a plurality of sections. Incidentally, in this case, it will suffice for an imaging area to be imaged at the imaging step to include an entire section to be painted in the step set including this imaging step. It is not needed for the imaging area to include the entire painting subject area.

In the foregoing embodiment, there was disclosed an illustrative arrangement in which the center portion painting step S1, the frame portion painting step S2, the imaging step S3, the unpainted area identifying step S4, and the correction painting step S5 are carried out in this order. However, in case the inventive painting method includes the imaging step, the unpainted area identifying step, and the correction painting step, the timing of effecting these steps is not limited as long as this timing is after the center portion painting step. For instance, the inventive painting method can be configured in the order of effecting the center portion painting step, the imaging step, and the unpainted area identifying step first, and then effecting the frame portion painting step and the correction painting step. In the case of this arrangement, since the frame portion painting step and the correction painting step can be executed simultaneously, the time required for painting can be reduced.

In the foregoing embodiment, respecting the unpainted area identifying step S4, there was explained an arrangement in which the unpainted area M0 is identified through an arithmetic processing of binarizing brightness of respective pixel of image data. However, in case the inventive painting method includes the unpainted area identifying step, its arithmetic processing method is not particularly limited. It may be any method that allows extraction of some difference existing between a painted area and an unpainted area. As some examples of such method, there can be cited a method based on color information difference represented by any color system such as RGB color system, CMY color system, CMYK color system, Lab color system, L*a*b*color system, greyscale, etc., a method of configuring a classifier capable of identifying an unpainted area through machine learning based on generated image data, and so on.

In the foregoing embodiment, respecting the correction painting step S5, there was explained an illustrative arrangement in which the unpainted area M0 is painted with using the jet nozzle 31. However, in case the inventive painting method includes the correction painting step, the method of painting the unpainted are is not particularly limited, and the painting is done with using an air atomizing nozzle, or using a nozzle different from the jet nozzle and also from the air atomizing nozzle.

In the foregoing embodiment, there was explained an illustrative arrangement in which the air atomizing nozzle unit 2 and the jet nozzle unit 3 respectively includes an arm portion (respectively, the first arm portion 22 and the second arm portion 32) independently. However, the invention is not limited to such arrangement. In the painting device relating to the present invention, the air atomizing nozzle and the jet nozzle may be provided in a same arm portion.

It should be understood that respecting the other arrangements too, the arrangements disclosed in this detailed disclosure are merely illustrative in all respects thereof and the scope of the present invention is not to be limited thereby. One skilled in the art will readily understand that modifications may be made appropriately within a range not departing from the essence of the present invention. Therefore, other embodiments modified within such range not departing from the essence of the invention shall be encompassed within the scope of the present invention as a matter of course.

INDUSTRIAL APPLICABILITY

The present invention may be used for e.g. painting of a graphic figure such as a logomark.

DESCRIPTION OF SIGNS

1: painting device
2: air atomizing nozzle unit
21: air atomizing nozzle
22: first arm portion
3: jet nozzle unit
31: jet nozzle
32: second arm portion
4: digital camera
5: control unit
51: controlling section
51*a*: air atomizing nozzle controlling portion
51*b*: jet nozzle controlling portion
52: arithmetic section
W: painting subject surface
L: demarcation line
M: logomark
M0: unpainted area
M1: frame portion
M2: center portion
m: paint line

The invention claimed is:

1. A painting method for painting a painting subject area whose edge shape is delimited by at least one demarcation line, the method comprising the steps of:

a center portion painting step of painting a center portion of the painting subject area which is away from the demarcation line using an air atomizing nozzle disposed within 5 cm or less from a painting subject surface;

a frame portion painting step of painting a frame portion of the painting subject area which is adjacent to the demarcation line using a jet nozzle, from which paint in the form of microdroplets is jetted continuously;

an imaging step of imaging the painting subject area to generate image data of the painting subject area;

an unpainted area identifying step of executing an arithmetic processing of identifying an unpainted area in the painting subject area based on the image data, the unpainted area being formed between the center portion and the frame portion; and a correction painting step of painting the unpainted area identified at the unpainted area identifying step.

2. The painting method of claim 1, wherein at the correction painting step, the unpainted area is painted using the jet nozzle.

3. A method for controlling a painting device having an air atomizing nozzle and a jet nozzle, from which paint in the form of microdroplets is jetted continuously, to paint a painting subject area whose edge shape is delimited by at least one demarcation line, the method comprising:

executing via a computer a center portion painting function of painting a center portion of the painting subject area, the center portion being away from the demarcation line, by controlling the air atomizing nozzle in an area located 5 cm or less from a painting subject surface;

executing via the computer a frame portion painting function of painting a frame portion of the painting subject area by controlling the jet nozzle, the frame portion being adjacent the demarcation line;

executing via the computer an imaging function of imaging the painting subject area to generate image data of the painting subject area;

executing via the computer an unpainted area identifying function of identifying an unpainted area in the painting subject area based on the image data, the unpainted area being formed between the center portion and the frame portion; and executing via the computer a correction painting function of painting the unpainted area identified by the unpainted area identifying function.

4. The painting method of claim 1, wherein the air atomizing nozzle is swept to paint the center portion with a plurality of paint lines, and wherein the unpainted area is formed between the end of the paint lines and the frame portion.

5. The painting method of claim 4, wherein at the correction painting step, the unpainted area is painted using the jet nozzle.

6. A painting method for painting a painting subject area whose edge is delimited by at least one demarcation line, the method comprising the steps of:

a first painting step of painting a first area of the painting subject area which is away from the demarcation line using an air atomizing nozzle;

a second painting step of painting a second area of the painting subject area which is adjacent to the demarcation line using a jet nozzle, from which paint in the form of microdroplets is jetted continuously;

an identifying step of identifying an unpainted area in the painting subject area after the first painting step and the second painting step; and a third painting step of painting the unpainted area identified in the identifying step.

7. The painting method according to claim 6, wherein the unpainted area is painted using the jet nozzle in the third painting step.

8. The painting method according to claim 6, wherein the air atomizing nozzle is disposed within 5 cm or less from the painting subject area in the first painting step.

9. The painting method according to claim 6, wherein, at the identifying step, the unpainted area is identified by analyzing an image of the painting subject area.

* * * * *